US006321551B1

(12) United States Patent
Backman et al.

(10) Patent No.: US 6,321,551 B1
(45) Date of Patent: Nov. 27, 2001

(54) SERIES SECONDARY COOLING AND DEHUMIDIFICATION SYSTEM FOR INDOOR ICE RINK FACILITIES

(76) Inventors: Thomas J. Backman, 105 Core Dr., Moorehead City, NC (US) 28557; James F. Roomsburg, 744 Rochelle Arch, Virginia Beach, VA (US) 23464

( * ) Notice: Subject to any disclaimer, the term of this patent is extended or adjusted under 35 U.S.C. 154(b) by 0 days.

(21) Appl. No.: 09/777,514

(22) Filed: Feb. 6, 2001

Related U.S. Application Data

(63) Continuation-in-part of application No. 09/316,836, filed on May 21, 1999, now Pat. No. 6,205,795.

(51) Int. Cl.[7] ..... A63C 19/10
(52) U.S. Cl. ..... 62/235; 62/93; 62/435
(58) Field of Search ..... 62/235, 434, 435, 62/93, 430

(56) References Cited

U.S. PATENT DOCUMENTS

| | | | | |
|---|---|---|---|---|
| 3,878,694 | * | 4/1975 | Holmsten | 62/235 |
| 5,042,262 | * | 8/1991 | Gyger et al. | 62/434 |
| 5,460,004 | * | 10/1995 | Tsimerman | 62/94 |
| 5,695,004 | * | 12/1997 | Beckwith | 165/104.21 |
| 5,802,864 | * | 9/1998 | Yarbrough et al. | 62/430 |
| 5,901,563 | * | 5/1999 | Yarbrough et al. | 62/234 |
| 6,029,467 | * | 2/2000 | Moratalla | 62/93 |

* cited by examiner

*Primary Examiner*—William E. Tapoical
*Assistant Examiner*—Mohammad M. Ali
(74) *Attorney, Agent, or Firm*—Mills Law Firm PLLC

(57) ABSTRACT

An indoor ice rink facility is provided with a dehumidifier coil connected with the ice rink refrigeration coils in a secondary refrigerant loop and a reheat coil coupled with the primary refrigerant loop for maintain the ice sheet and controlling the humidity of the facility in a single system.

7 Claims, 2 Drawing Sheets

SERIES SECONDARY COOLING AND DEHUMIDIFICATION SYSTEM FOR INDOOR ICE RINK FACILITIES

REFERENCE TO RELATED APPLICATIONS

This application is a continuation-in-part application of U.S. patent application Ser. No. 09/316,836 filed on May 21, 1999 now U.S. Pat. No. 6,205,795 in the name of Thomas J. Backman et al. and entitled "Series Secondary Cooling System".

FIELD OF THE INVENTION

The present invention relates to secondary loop refrigeration, and in particular, to a method and apparatus using secondary loop cooling for controlling temperature and humidity in an ice rink facility.

BACKGROUND OF THE INVENTION

The cooling system for commercial and retail establishments generally comprise a remotely located primary unit that is individually connected to the various cooling loads or zones therein, such as air conditioning, low temperature freezer units, and mid-temperature refrigeration units. Such arrangements in a typical supermarket refrigeration system oftentimes require hundreds or thousands of pounds of refrigerant charge in addition to thousands of feet of refrigerant lines. Additionally, plural primary units may be employed, however, each conditioned area nonetheless requires individual connection.

The problems associated with the above approaches have been further complicated by changes in the permissibility and availability of direct expansion refrigerants commonly used for such systems. Certain chlorofluorocarbons and hydro chlorofluorocarbons are being phased out because of their environmental impact. To the extent obtainable, the cost of such refrigerants are increasing markedly making the cost of the installed system considerably more expensive. Certain non-chlorinated low temperature and medium temperature refrigerants have been developed as alternatives, however, they tend to be even more costly. Other high temperature direct expansion refrigerants, such as R-134a, are more moderate in cost, but are not effective in direct expansion cooling systems below air conditioning temperatures.

The foregoing problems have prompted refrigeration equipment manufacturers to propose the use of secondary liquid cooling. Therein, a primary condensing unit is closely coupled to a direct expansion heat exchanger. The refrigerant for the primary system may be selected based on performance, and because of the shorter supply lines the cost thereof is reduced. The direct expansion heat exchanger is coupled to a secondary system using a liquid secondary refrigerant. The secondary refrigerant is pumped through individual secondary lines to the liquid chilling coils in various temperature control zones, such a refrigerated displays, walk-in coolers and the like.

One such system is disclosed in U.S. Pat. No. 5,713,211 to Sherwood. Therein, a liquid secondary refrigerant is directed in a secondary cooling loop from a primary-secondary heat exchanger to a series of display cases and pumped back to the heat exchanger. Only a single zone, of the many zones typically found in commercial applications, is covered in the secondary loop. The secondary loop is not operative to provide coil defrosting.

Another approach is disclosed in U.S. Pat. No. 5,524,442 to Bergman et.al. wherein a secondary refrigeration loop employs an open loop air stream that directly impinges a product to be cooled. The secondary loop return air system is directed to a secondary heat exchanger interfaced with a primary refrigeration loop.

A plurality of secondary refrigeration loops using a single refrigerant are disclosed in U.S. Pat. Nos. 5,318,845 to Dorini et. al. and 5,138,845 to Mannion et. al. Therein, the return lines of the primary refrigeration are fed in parallel as the inlet lines to the secondary cooling loads and the secondary return lines are connected with the primary inlet lines. Control systems are provided with each cooling load to control temperature and flow rates. While providing some localization of lines, a single refrigerant charge for the cooling demands of the generally similar temperature demands of the various units of the system.

A further approach is disclosed in U.S. Pat. No. 5,042,262 to Gyger et. al. wherein second closed loop system is operative to transfer heat from a single heat sink using carbon dioxide as a secondary refrigerant.

It is apparent from the above that such secondary loop designs have not focused on the major problems associated with plural refrigerant systems, i.e. consolidation of the high cost/high performance primary refrigerant loop and a secondary loop capable of handling plural cooling zones of the type found in supermarkets, cold storage facilities, hospitals, industrial plants, hotels, shopping centers, and like locations requiring cooling, refrigeration and heating. By focusing on parallel exchanges, high fluid volume cost, high equipment costs, and power consumption for fluid transfer remain a problem.

Similar and other problems in specialized refrigerated applications such as indoor ice rink facilities. Therein, the ice rink surface, comprised of a refrigerated bed and covered by successive layers of ice, is maintained at subfreezing temperatures by a liquid secondary cooling loop, customarily utilizing glycol as the liquid refrigerant. The equipment and technology for maintaining the ice surfaces; has generally reliable service. The environment of the ice rink facility poses secondary problems, namely dehumidification, that have heretofore required costly auxiliary systems.

In operation, the ice sheet, outdoor air, participants and crowds generate high ambient humidity levels causing moisture to condense on cooler surfaces, such as ceilings, and fog to accumulate at the rink surface. This moisture can drip onto the ice sheet impairing the quality thereof. The humidity levels are also unpleasant for the rink participants and attendants.

Various approaches have been used for handling the humidity levels to insure quality ice surfaces and provide conform for the users. Currently, the preferred systems use desiccants for removing excess humidity. However such systems are costly and may not be effective during periods of extreme humidity conditions.

SUMMARY OF THE INVENTION

The present invention addresses and overcomes the aforementioned problems and limitations by providing a secondary refrigeration system incorporating a continuous series of progressively increasing temperature zones in a single secondary cooling loop. Therein, a secondary fluid is interfaced with the primary system and has the fluid feed line connected in parallel to a plurality of cooling loads having the highest cooling demands, such as freezer units. The return lines of the first loads are combined and fed to a second zone of cooling loads having the next highest cooling demand, such as refrigerated displays. Thereafter the second zone return lines are fed back to the heat exchanger or to subsequent zones in a similar manner, such as air conditioning equipment.

Such design eliminates the need for individual piping for each zone thereby reducing refrigerant, equipment, power consumption and piping costs. Moreover, the heat exchanger may be bypassed for defrosting the coils in the zones wherein the temperature rise from the line loading will warm the coils sufficiently for defrosting, while upon completion of defrosting, the system may be quickly returned to operative status. Furthermore, the aforementioned design permits the use of low cost non-chlorinated fluids operative in the liquid phase providing the requisite viscosity, specific heat, thermal conductivity, and environmental acceptability while providing efficient heat transfer within temperatures ranging from −40° F. to +80° F.

The invention may also be incorporated at indoor ice rink facilities for maintaining the ice rink sheet and controlling humidity in the facility to eliminate condensation conditions impairing the quality of the ice surface and the comfort of the participants thereat. Therein, the ice rink coils are connected in the secondary refrigerant loop with a dehumidification coil in the indoor rink facility air handling system for controlling the humidity. A reheat coil thermally coupled with the primary refrigerant loop serves to reheat the dehumidified air prior to return to the facility. The resultant system provides ready control of rink temperature as well as controlling facility environment conditions in a cost effective cooling, heating and dehumidification system.

Accordingly, it is an object of the present invention to provide a secondary cooling system having reduced material, equipment and operating costs in conditioning a plurality of cooling zones.

A further object of the invention is to provide a plurality of increasing temperature zones that are serially connected in a secondary cooling loop.

Another object of the invention is to provide secondary cooling loop system using environmentally acceptable high performance refrigerants in a liquid phase with chilling coils in a series connection of increasing temperature zones.

Yet another object of the invention is to provide a liquid secondary refrigeration loop connecting a plurality of cooling zones wherein the loop may be quickly and conveniently disabled allowing the latent heat from the units to raise the temperature of the fluid sufficiently for defrosting purposes.

Still another object of the invention is to provide a cooling and dehumidification system for an indoor ice rink facility using a dehumidification coil in a secondary refrigeration loop and a reheat coil in a primary refrigeration loop.

DESCRIPTION OF DRAWINGS

The above and other objects and advantages of the present invention will become apparent upon reading the following detailed description taken in conjunction with the accompanying drawings in which.

DETAILED DESCRIPTION OF THE PREFERRED EMBODIMENT

Figure 1:
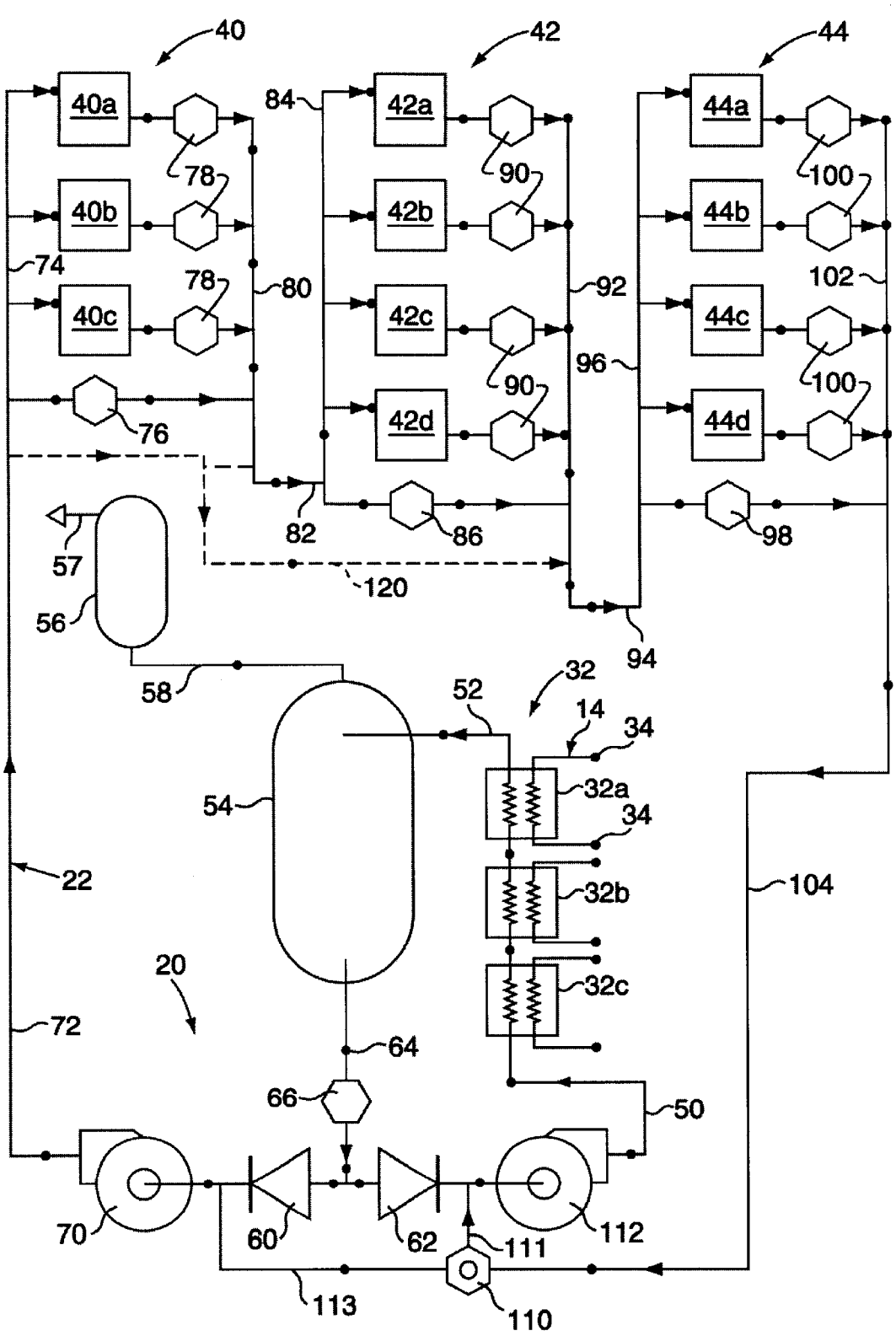
FIG. 1 is a schematic diagram of a serial banked secondary refrigeration system in accordance with the present invention.

Referring to the drawings for the purpose of describing a preferred embodiment of the present invention and not for limiting same, FIG. 1 shows a refrigeration system 10 for a facility having a plurality of cooling zones or loads to be maintained respectively at differing temperatures.

The system 10 includes a primary refrigeration system 12 for transferring heat in a primary loop 14 to an external environment using a primary refrigerant, and a secondary loop refrigeration system 20 for transferring heat from the cooling zones in a secondary loop 22 to the primary refrigeration system 12 using a secondary refrigerant. The system 10 is suitable for installation in a supermarket setting and will be described with reference thereto. However, it will become apparent that the system may be beneficially utilized in other multiple zone venues including without limitation cold storage facilities, hospitals, refrigerated industrial plants, hotels, shopping centers, laboratories, prisons, schools and industrial, institutional, commercial and residential spaces requiring temperature control at varying levels in multiple zones.

The primary refrigeration system 12 may be any suitable commercially available design comprising typically a remotely located compressor unit (not shown), located external of the facility and typically on the roof thereof, having inlet lines 30 communicating with a multiple stage direct-expansion evaporator 32 having stages 32*a*, 32*b* and 32*c*; and a return line 34 returning to the compressor unit. A suitable primary refrigerant for the primary loop would be R-22, R-404A, R-717 or R-507. The evaporator 32 is preferably located proximate the compressor unit in order to minimize the length of the primary loop 12 and the primary refrigerant charge, but with convenient access to the cooling zones to be controlled.

As described below in greater detail, the secondary refrigeration system 20 is connected with cooling zones or loads including a low temperature units 40, such as freezers maintained in the operating range of about −40° F. to +9° F., medium temperature units 42 maintained in the operating range of about +10° F. to +38° F., and air conditioned units 44 maintained in the operating range of about 39° F. to 80° F. Plural units are illustrated for each zone, however, it will be appreciated that the number of units and zones will vary depending on the requirements of a particular facility.

The secondary refrigeration system includes an inlet line 50 leading to the evaporator 32, an exit line 52 leading from the evaporator 32 to a coolant reservoir 54. An expansion tank 56 having a pressure relief valve 57 is connected to the reservoir 54 by line 58. The reservoir 54 is connected with branched check valve 60, 62 through exit line 64 that includes a pressure regulator 66. Refrigerated fluid from the reservoir 54 flows past check valve 60 to a supply pump 70. The supply pump 70 is effective for maintaining flow and pressure conditions through the temperature zones and may be either a constant volume or constant pressure pump depending on the overall needs of the cooling system. At various locations as illustrated by the unnumbered solid circles, isolation valve may be provided for temporarily isolating discrete sections of the system. The secondary refrigerant flows from the pump 70 through line 72 to a low temperature inlet manifold 74 having parallel inlet lines respectively communicating with freezer units 40*a*, 40*b*, 40*c*, and bypass valve 76. The outlet lines of the freezer units include temperature control valves 78 communicating in parallel with the exit line of valve 76 with a low temperature exhaust manifold 80. In a conventional manner, the valves 78 are individually effective to maintain desired temperature conditions in the units 40 in a well known manner. The bypass valve 76 may be stepped or continuous varied by appropriate controls to maintain volumetric flow conditions in the secondary loop 22 sufficient for the overall needs of the system 10. Additionally, the intake manifold 74 and the units 40 may include isolation valves, as illustrated, for removing the units from operation for service, replacement and the like.

The exhaust manifold 80 of the low temperature units 40 is connected by intermediate line 82 with a mid-temperature intake manifold 84 having inlets communicating with the mid-temperature units 42*a*, 42*b*, 42*c*, 42*d* and bypass valve 86. The outlet lines of the refrigerator units include temperature control valves 90 communicating in parallel with the exit line of valve 86 with a mid-temperature exhaust manifold 92. In a conventional manner, the valves 90 are individually effective to maintain desired temperature conditions in the refrigeration units 42 in a well-known manner. The bypass valve 86 may be stepped or continuous varied by appropriate controls to maintain volumetric flow conditions in the secondary loop 22 sufficient for the overall needs of the system 10. Additionally, units 42 may include isolation valves for removing the units from operation for service, replacement and the like.

The exhaust manifold 92 of the mid-temperature units 42 is connected by intermediate line 94 with a high-temperature intake manifold 96 having inlets communicating with the air conditioning units 44*a*, 44*b*, 44*c*, 44*d* and bypass valve 98. The outlet lines of the air conditioning units include temperature control valves 100 communicating in parallel with the exit line of valve 98 with an air conditioning exhaust manifold 102. In a conventional manner, the valves 100 are individually effective to maintain desired temperature conditions in the air conditioning units. The bypass valve 96 may be stepped or continuous varied by appropriate controls to maintain volumetric flow conditions in the secondary loop 22 sufficient for the overall needs of the system 10. Additionally, units 44 may include isolation valves for removing the units from operation for service, replacement and the like.

The exhaust manifold 102 is connected by line 104 to the inlet of a three-way defrost valve 110. One outlet line from the valve 110 is fluidly connected between check valve 60 and supply pump 70. The other outlet line from defrost valve 110 is fluidly connected between check valve 62 and circulation pump 112 that has an outlet connected with the inlet line 50 to the heat exchanger 32. A further isolation circuit 120, illustrated by the dashed lines, may be included.

It will thus be appreciated that the three sets of cooling loads are serially connected in the secondary loop 22, with parallel flow across the individual units in each stage. Such arrangement avoids the need for individual fluid connections with each stage, thereby reducing equipment, installation and refrigerant costs. Further, by operating the secondary loop in the liquid phase, numerous non-chlorinated, lower cost refrigerants may be employed. In particular, R-134a, while compatible with direct expansion systems is surprisingly effective in the fluid stages of the present invention providing an operational range from about −40° F. to +80° F. Other refrigeration fluids suitable for the secondary system include: glycol solutions, propylene glycol, ethylene glycol, brines, inorganic salt solutions, potassium solutions, potassium formiate, silicone plymers, synthetic organic fluids, eutectic solutions, organic salt solutions, citrus terpenes, hydrofluouroethers, hydrocarbons, chlorine compounds, methanes, ethanes, butane, propanes, pentanes, alcohols, diphenyl oxide, biphenyl oxide, aryl ethers, terphenyls, azeotropic blends, diphenylethane, alkylated aromatics, methyl formate, polydimethylsiloxane, cyclic organic compounds, zerotropic blends, methyl amine, ethyl amine, ammonia, carbon dioxide, hydrogen, helium, water, neon, nitrogen, oxygen, argon, nitrous oxide, sulfur dioxide, vinyl chloride, propylene, R400, R401A, R402B, R401C, R402A, R402B, R403A, R403B, R404A, R405A, R406A, R407A, R407B, R407C, R407D, R408A, R409A, R409B, R410A, R410B, R411A, R411B, R412A, R500, R502, R503, R504, R505, R506, R507A, R508A, R508B, R509A, R600A, R1150, R11, R113, R114, R12, RR22 R13, R116, R124, R124A, R125, R143A, R152A, R170, R610, R611, sulfur compounds, R12B1, R12B2, R13B1, R14, R22B1, R23, R32, R41, R114, R1132A, R1141, R1150, R1270, fluorocarbons, carbon dioxide, solutions of water, and combinations of the above fluids.

Operation of the Secondary Fluid Cooling System

With the primary system operating, the pumps 70 and 112 are started to circulate the secondary refrigerant in the secondary loop 22. The capacity of the secondary loop 22 will be dependent on the cooling loads for the individual stages and the capacity of the evaporator 32. Generally the entry temperatures for the secondary refrigerant are −40 F. to 0 F. for the freezer stage, +1 F. to +30 F. for the refrigeration stage, and +34 F. to +50 F. for the air conditioning stage. Passing through the first stage, the secondary refrigerant will experience a temperature rise based on the demand thereat, however, the entrance temperature and flow at the second stage for handling the refrigeration requirements in the refrigeration units. Similarly, the conditions presented to the air conditioning units will be sufficient to handle the load requirements for this stage.

Operation of the Defrost Cycle

From time to time, the cooling coils at the units may experience a frost or ice buildup limiting the cooling performance of the units. The secondary cooling system of the present invention may be quickly reconfigured to initiate a defrost cycle therefor. Such a cycle may be initiated by switching the position of the defrost valve 110 to the defrost position routing the fluid from line 104 to line 113. This results in plural flow paths. First, circulation of the fluid will be maintained between the reservoir 54 and the evaporator 32 by pump 112 thereby maintaining a supply of cooled refrigerant for immediate use after the defrost cycle. Second, a loop will be established bypassing the evaporator 32 and reservoir such that the temperature rise in the secondary refrigerant experienced at the air conditioning stage will circulate through the freezer and refrigerator coils thereby defrosting and deicing the associated units. Upon completion of the defrost cycle, the valve 110 is reversed and refrigerated fluid is immediately circulated in the secondary loop for quickly restoring refrigerated operating conditions.

Ice Rink Cooling and Dehumidification System

Figure 2:
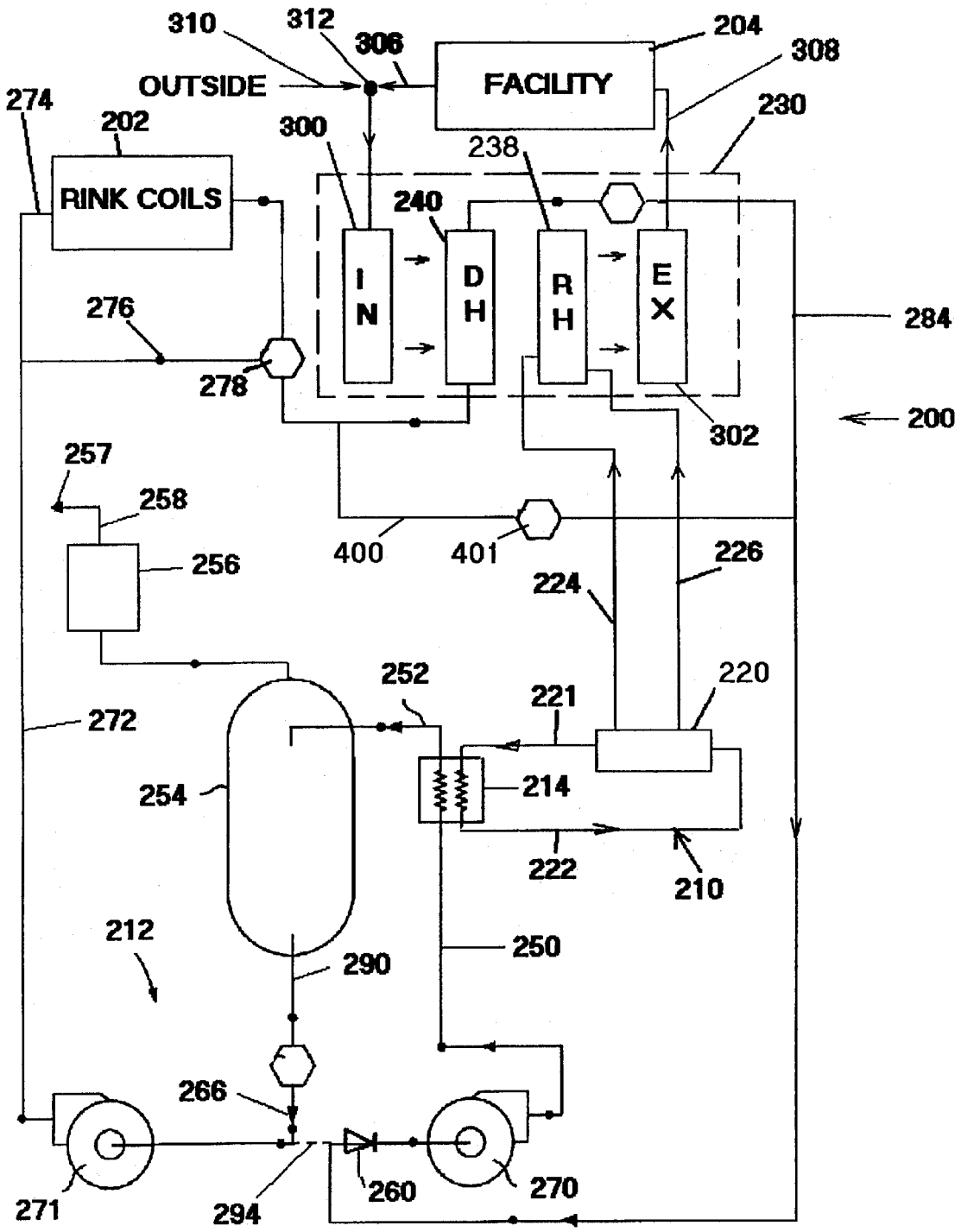
FIG. 2 is a schematic diagram of a series secondary cooling and dehumidification system for an indoor ice rink facility.

Referring to FIG. 2, there is shown an embodiment of the above cooling system for maintaining a indoor ice rink and dehumidifying the accompanying structure. Therein, a series secondary cooling and dehumidification system 200 for maintaining the ice sheet refrigeration coils 202 of a conventional ice rink located in an indoor facility 204 includes a primary refrigerant system 210 coupled with a secondary refrigerant refrigeration system 212 at direct expansion evaporator 214.

The primary refrigeration system 210 is a direct expansion system and includes a compressor 220 connected by lines 221, 222 with the evaporator 214 and by lines 224, 226 with a reheat coil 228 of the facility air handler 230. The primary refrigeration system 210 may employ any suitable direct expansion refrigerant, preferably R-22 or R-404a. The reheat coil 228 is connected with the compressor 220 in thermal exchange relationship therewith. The lines 224, 226 may be connected in parallel with the lines 221, 222 or may be coupled with a liquid heat exchanger conventionally incorporated into the compressor unit in such applications. The compressor 220 is typically located external of the facility and typically on the roof thereof. The evaporator 214 is preferably located proximate the compressor unit in order to minimize the length of the primary refrigerant loop and the primary refrigerant charge, but with convenient access to the cooling zones to be controlled.

The secondary refrigeration system 212 is connected in series with the rink coils 202 and dehumidification coils 240 in the air handler 230. The rink coils 202 are generally maintained in the operating range of about +15° F. to +25° F. and the dehumidification coils 240 are generally maintained in the operating range of about +30° F. to +40° F. Appropriate control and valve systems are incorporated to maintain such operating ranges.

The secondary refrigeration system includes an inlet line 250 leading to the evaporator 214, an exit line 252 leading from the evaporator 214 to a coolant reservoir 254. An expansion tank 256 having a pressure relief valve 257 is connected to the reservoir 254 by line 258. The reservoir 254 is connected with branched check valves 260, 262 through exit line 264 that includes a pressure regulator 266. Refrigerated fluid from the reservoir 254 flows past check valve 260 to a supply pump 270. The supply pump 270 is effective for maintaining flow and pressure conditions through the temperature zones and may be either a constant volume or constant pressure pump depending on the overall needs of the cooling system. At various locations as illustrated by the unnumbered solid circles, isolation valve may be provided for temporarily isolating discrete sections of the system.

The secondary refrigerant flows from the optional pump 271 through line 272 to inlet line274 communicating with the rink coils 202. The outlet line 276 of the rink coils 202 includes temperature control valve 278. In a conventional manner, the optional valve 278 is effective to maintain desired temperature conditions in the rink coils 202 in a well known manner, typically around +20° F. The valve 278 may be stepped or continuous varied by appropriate controls to maintain volumetric flow conditions in the secondary refrigeration system 212 sufficient for the overall needs. Additionally, the secondary refrigeration system may include isolation valve 279 in a bypass line for accommodating service, replacement and the like. Suitable secondary refrigerants include salt brine, ethylene glycol, and combinations thereof.

The optional outlet line 276 is connected to the inlet line 280 of the dehumidification coil 240. The exhaust line 280 from the dehumidification coil 240 is connected by line 284 to the pump 270 at valve 260. The pump 270 is connected with the evaporator by line 250. A further isolation circuit 294, illustrated by the dashed lines, may be included.

The air handler 230 includes the dehumidification coil 240, the reheat coil 238, an intake 300 and an exhaust 302. The intake 300 and exhaust 302 are coupled conventionally with the facility 204 through intake duct 306 and exhaust duct 308 for maintaining desired temperature and humidity conditions therein, particularly avoiding excess humidity operation susceptible to causing condensation on the facility interior structure that can pose detrimental conditions to the quality of the ice sheet. Outside air 310 may be admitted to the intake duct 306 at flow control valve 312 for adjusting facility air quality according to conventional means. Typically, the air handler 230 is operated to maintain the facility in the range of about 60° F. to 70° F. at a suitable relative humidity. Suitable filtration and auxiliary heaters may also be incorporated in to the air handling system.

The above description is intended to be illustrative of the preferred embodiment, and modifications and improvements thereto will become apparent to those in the art. Accordingly, the scope of the invention should be construed solely in accordance with the appended claims.

What is claimed:

1. In an indoor ice rink facility having an ice sheet maintained by a rink refrigeration cooling system and an enclosed volume to be environmentally controlled with a facility air handling system, a cooling and dehumidification system comprising: a direct expansion primary refrigeration loop and a liquid secondary refrigeration loop thermally coupled at a heat exchanger, said secondary refrigeration loop serially connecting the rink refrigeration cooling system with a dehumidification unit in the air handling system, said primary refrigeration loop being thermally coupled with a reheat unit in the air handling system.

2. The cooling and dehumidification system as recited in claim 1 wherein said reheat unit is fluidly connected with said primary refrigeration loop.

3. The cooling and dehumidification system as recited in claim 1 wherein said secondary refrigeration loop includes a refrigerant charge comprising brine, ethylene glycol, or a combination thereof.

4. The cooling and dehumidification system as recited in claim 3 wherein said primary refrigeration loop includes a refrigerant charge comprising R-22, R-717 or R-404a.

5. The cooling and dehumidification system as recited in claim 4 wherein said reheat unit is thermally coupled at a compressor in said primary refrigeration loop.

6. an indoor ice rink facility, comprising: a facility enclosure having an ice rink carrying an ice sheet; a liquid refrigerant cooling means for maintaining said ice sheet; a air handling system for said enclosure having an inlet and an outlet; a primary refrigeration loop including a compressor and carrying a direct expansion refrigerant; a reheat coil thermally coupled with said compressor and carried in said air handling system adjacent said outlet; a direct expansion evaporator unit thermally coupled with said primary refrigeration loop; a secondary refrigeration loop carrying a liquid refrigerant and thermally coupled with said evaporator unit, said secondary refrigeration loop serially thermally connected with said cooling means for said ice rink and a dehumidification unit in the air handling system adjacent said inlet.

7. A cooling system for an indoor ice rink facility having an ice sheet maintained by a rink refrigeration cooling system and an air handling system for an enclosed volume to be environmentally controlled comprising: a primary refrigeration loop and a liquid secondary refrigeration loop; heat exchange means thermally coupling said loops; and means serially thermally connecting said secondary refrigeration loop with the rink refrigeration cooling system and subsequently with a dehumidification unit in the air handling system.

* * * * *